US010435267B2

(12) United States Patent
Ashton

(10) Patent No.: US 10,435,267 B2
(45) Date of Patent: Oct. 8, 2019

(54) CONTAINER FOR THREAD DISTRIBUTION AND NEEDLE STORAGE

(71) Applicant: Quawana Renia Ashton, Las Vegas, NV (US)

(72) Inventor: Quawana Renia Ashton, Las Vegas, NV (US)

( * ) Notice: Subject to any disclaimer, the term of this patent is extended or adjusted under 35 U.S.C. 154(b) by 0 days.

(21) Appl. No.: 16/109,497

(22) Filed: Aug. 22, 2018

(65) Prior Publication Data

US 2019/0071275 A1 Mar. 7, 2019

Related U.S. Application Data

(60) Provisional application No. 62/553,678, filed on Sep. 1, 2017.

(51) Int. Cl.

| | |
|---|---|
| ***D05B 91/16*** | (2006.01) |
| ***B65H 49/06*** | (2006.01) |
| ***A41G 5/00*** | (2006.01) |
| ***B65D 85/04*** | (2006.01) |
| *B65D 83/00* | (2006.01) |

(52) U.S. Cl.

CPC ..... *B65H 49/06* (2013.01); *A41G 5/002* (2013.01); *B65D 85/04* (2013.01); *D05B 91/16* (2013.01); *A41G 5/0086* (2013.01); *A45D 2200/05* (2013.01); *B65D 83/00* (2013.01)

(58) Field of Classification Search

CPC ..... B65H 49/04; B65H 49/06; B65H 49/08; B65H 49/10; B65H 49/14; D05B 91/14; D05B 91/16

USPC ..... 223/99, 106, 107, 108, 109 R

See application file for complete search history.

(56) References Cited

U.S. PATENT DOCUMENTS

| | | | | | |
|---|---|---|---|---|---|
| 141,409 | A | * | 7/1873 | Wilcox | D05B 91/14 223/107 |
| 142,786 | A | * | 9/1873 | Hinckley | B65H 35/0006 225/35 |
| 192,215 | A | * | 6/1877 | Barlow, Jr. | D05B 91/14 223/106 |
| 385,937 | A | * | 7/1888 | Lee | A61B 17/06133 206/63.3 |
| 1,302,305 | A | * | 4/1919 | Byers | D05B 91/14 223/107 |
| 1,522,973 | A | * | 1/1925 | Ockfen | D05B 91/14 223/106 |
| 1,794,776 | A | * | 3/1931 | Klatt | D05B 91/14 223/107 |

(Continued)

*Primary Examiner* — Nathan E Durham
(74) *Attorney, Agent, or Firm* — Perkins Coie LLP

(57) ABSTRACT

A container is described for storing various tools and items for sewing in an organized manner and facilitating the process of sewing (e.g., for sewn in hair extensions) for example, by distributing thread. In an example embodiment, the introduced container comprises a housing within which one or more spools of thread can be stored on one or more spindles. The housing can be enclosed by a container top that includes a threading hole through which thread from the one or more spools can be extracted from the interior of the housing, while in use. Further, the container top can include a pin and/or needle holder such as a pin cushion. The container may include additional features such as a bracket for holding a pair of scissors and a drawer for stowing extra thread and/or needles.

18 Claims, 15 Drawing Sheets

(56) References Cited

U.S. PATENT DOCUMENTS

| | | | | | |
|---|---|---|---|---|---|
| 1,946,276 | A | * | 2/1934 | De Castro-Barberena | B65D 25/04 206/227 |
| 2,245,087 | A | * | 6/1941 | Clanton | D05B 91/14 223/107 |
| 2,249,980 | A | * | 7/1941 | Reichart | D05B 91/14 223/107 |
| 2,646,908 | A | * | 7/1953 | Madan | D05B 91/14 223/107 |
| 2,679,341 | A | * | 5/1954 | Tinker | D05B 91/14 211/78 |
| 3,018,067 | A | * | 1/1962 | Vandervoort | D05B 43/00 242/137 |
| 4,026,063 | A | * | 5/1977 | Allen | A01K 97/06 206/408 |
| 5,002,211 | A | * | 3/1991 | Caldwell | D05B 91/14 223/106 |
| 2017/0208886 | A1 | | 7/2017 | White et al. | |

* cited by examiner

CONTAINER FOR THREAD DISTRIBUTION AND NEEDLE STORAGE

CROSS-REFERENCE TO RELATED APPLICATION(S)

This application claims the benefit of U.S. Provisional Patent Application No. 62/553,678 filed on Sep. 1, 2017, and titled "CONTAINER FOR THREAD DISTRIBUTION AND NEEDLE STORAGE," which is incorporated by reference herein in its entirety.

TECHNICAL FIELD

The present invention relates to storage and distribution of thread and other tools used during sewn in hair extension services or other sewing activities.

BACKGROUND

Sewn in extensions have and always will be one of many essential extension services. A sewn in extension service is executed by braiding the client's natural hair to their scalp in a cornrow fashion then sewing in a hair extension (also known as a weft) to the cornrow using needle and thread.

DETAILED DESCRIPTION

Overview

Sewing can involve the use of various different tools and items such as a needle, thread, and scissors. For example, a hair stylist may utilize such tools and items while sewing in hair extensions. Often, to effectively sew in the extensions, a hair stylist may access and handle more than one tool or item at a time, often using one available hand. For example, while holding a hair extension in place with one hand, a hair stylist may need to access needle and thread with the other hand. This can be challenging for the hair stylist performing the hair extension, particularly if the requisite tools and items are not readily at hand or organized.

To address these challenges, a container is introduced for storing various tools and items in an organized manner and facilitating the process of sewing (e.g., for hair extensions), for example, by distributing thread. In an example embodiment, a container comprises a housing within which one or more spools of thread can be stored on one or more spindles. The housing can be enclosed by a container top that includes a threading hole through which thread from the one or more spools can be extracted from the interior of the housing, while in use. Further, the container top can include a pin and/or needle holder such as a pin cushion. The container may include additional features such as a bracket for holding a pair of scissors and a drawer for stowing extra thread and/or needles. By arranging all of these elements in a single container, a user such as a hair stylist can easily access all the materials when sewing. Further, the portable nature of the container allows a user to easily transport all the materials. Note that while certain embodiments are described herein in the context of performing sewn in hair extensions, the disclosed container is not limited to such applications. Embodiments of the disclosed container can similarly be utilized for any other application that involves a needle and/or thread.

Figure 5:
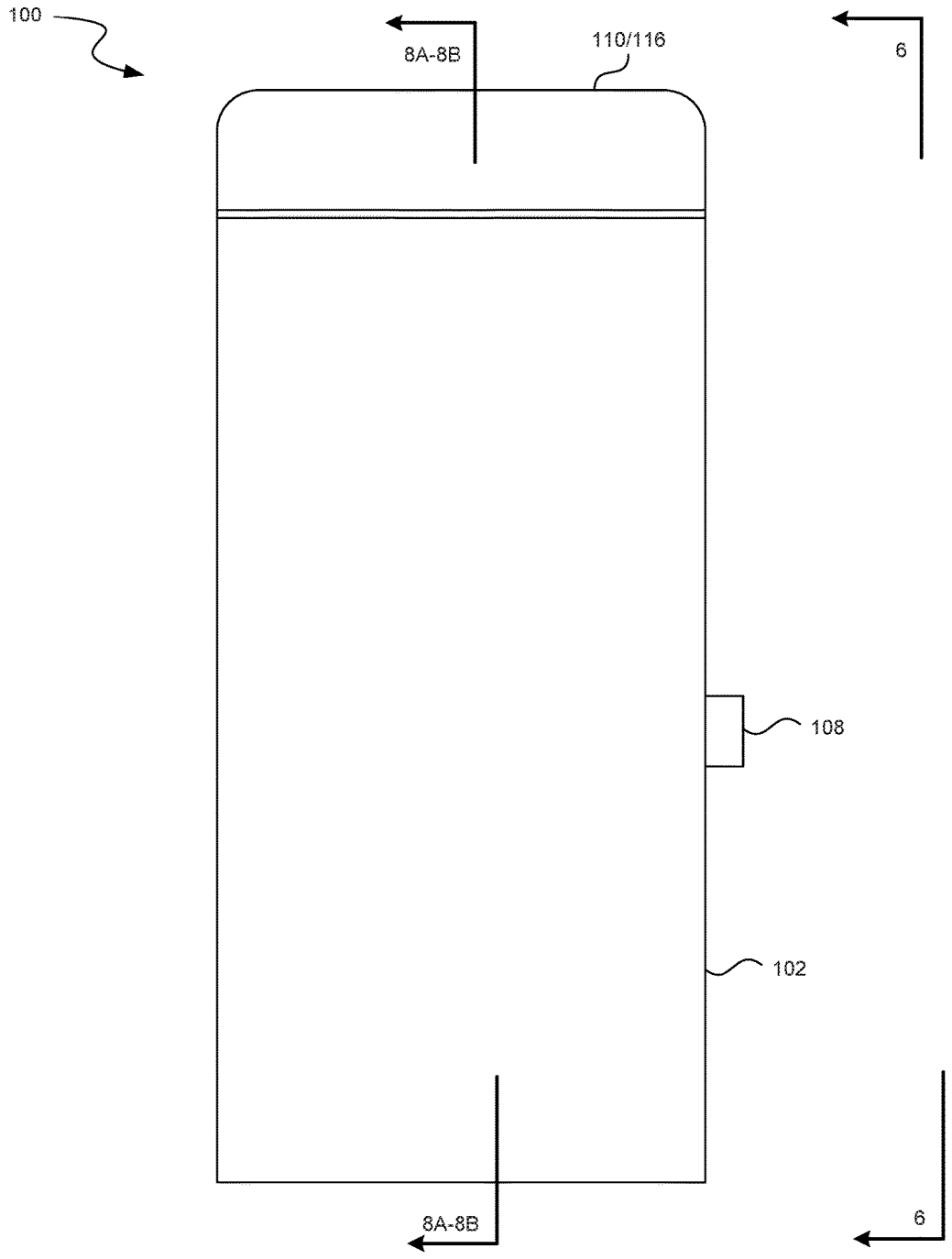
FIG. 5 shows a front elevation view of the example container of FIG. 1 with the container top closed.
Figure 6:
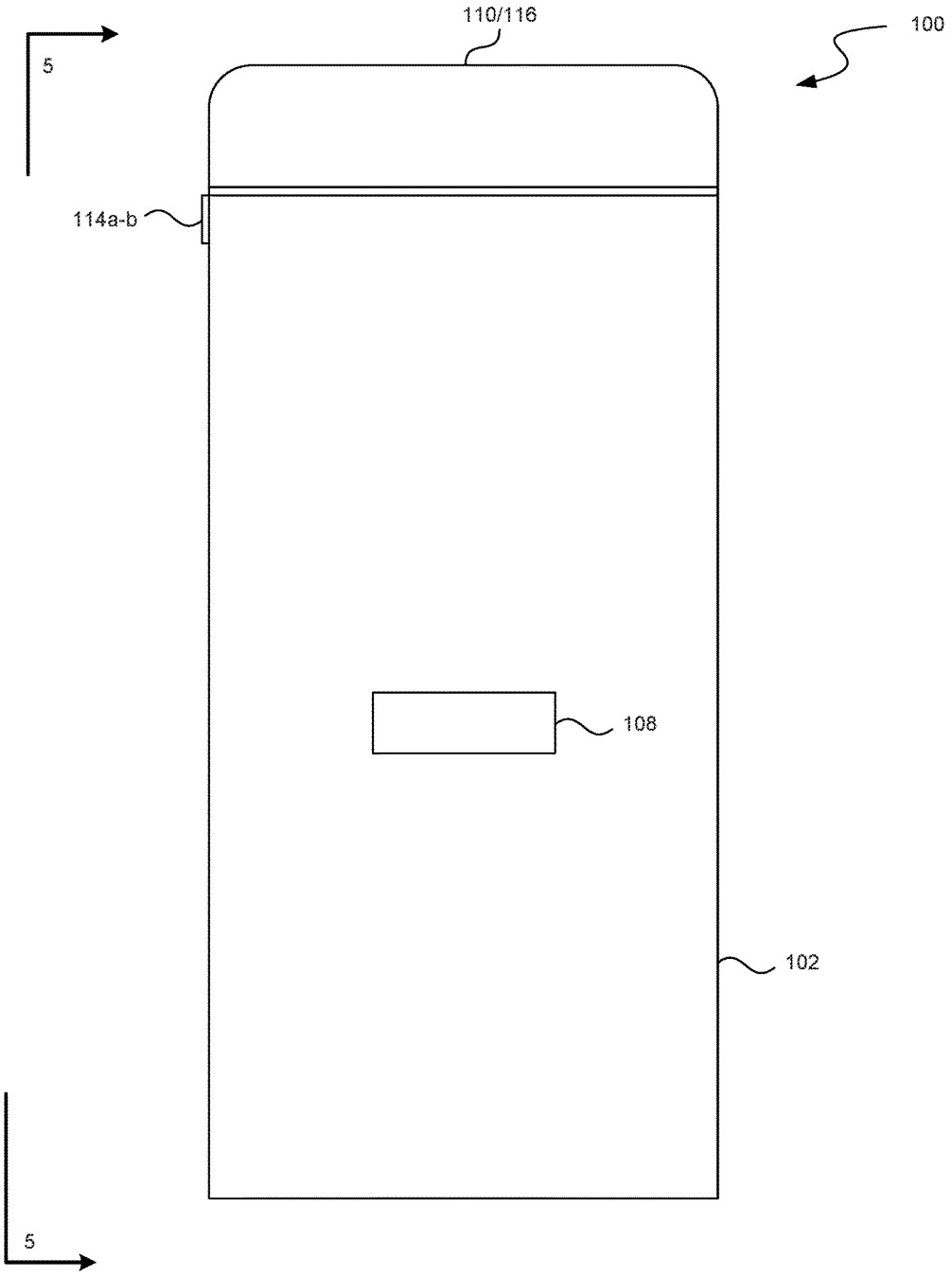
FIG. 6 shows a side elevation view of the example container of FIG. 1 with the container top closed.
Figure 7:
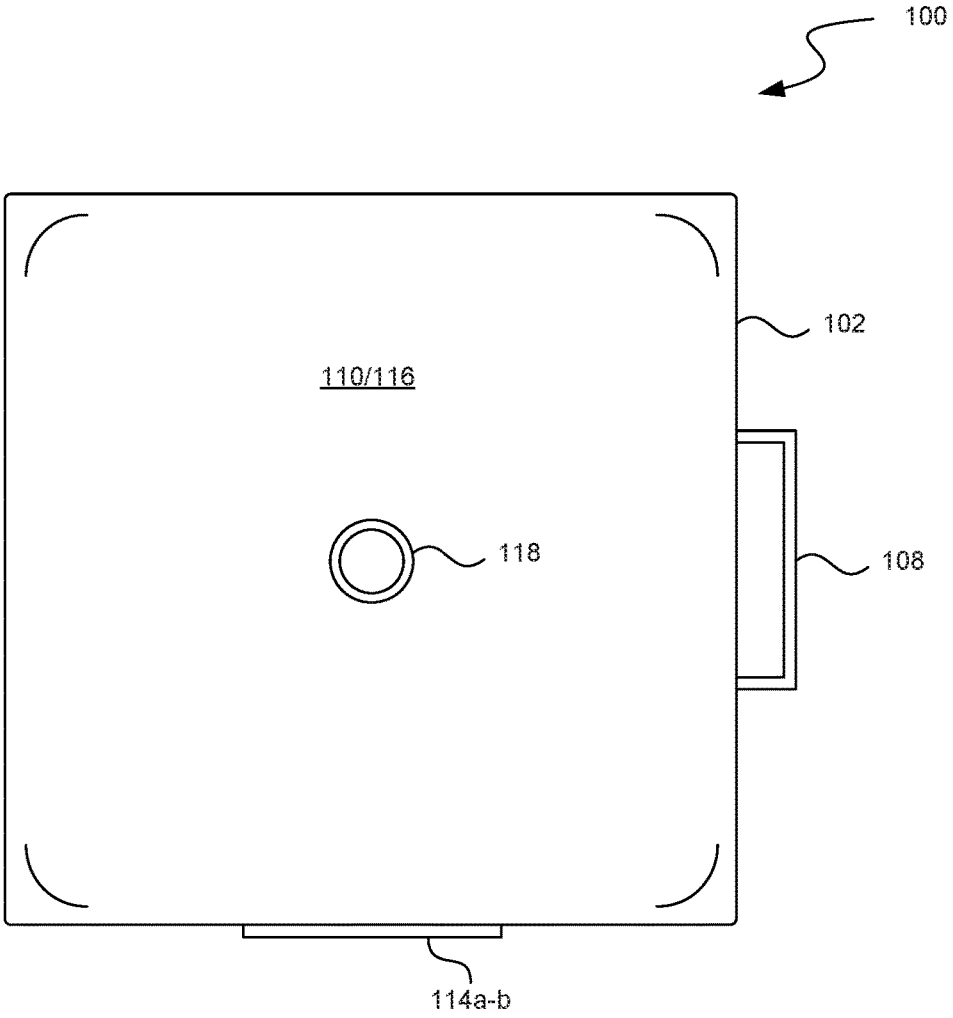
FIG. 7 shows a top view of the example container of FIG. 1 with the container top closed.
Figure 8A:
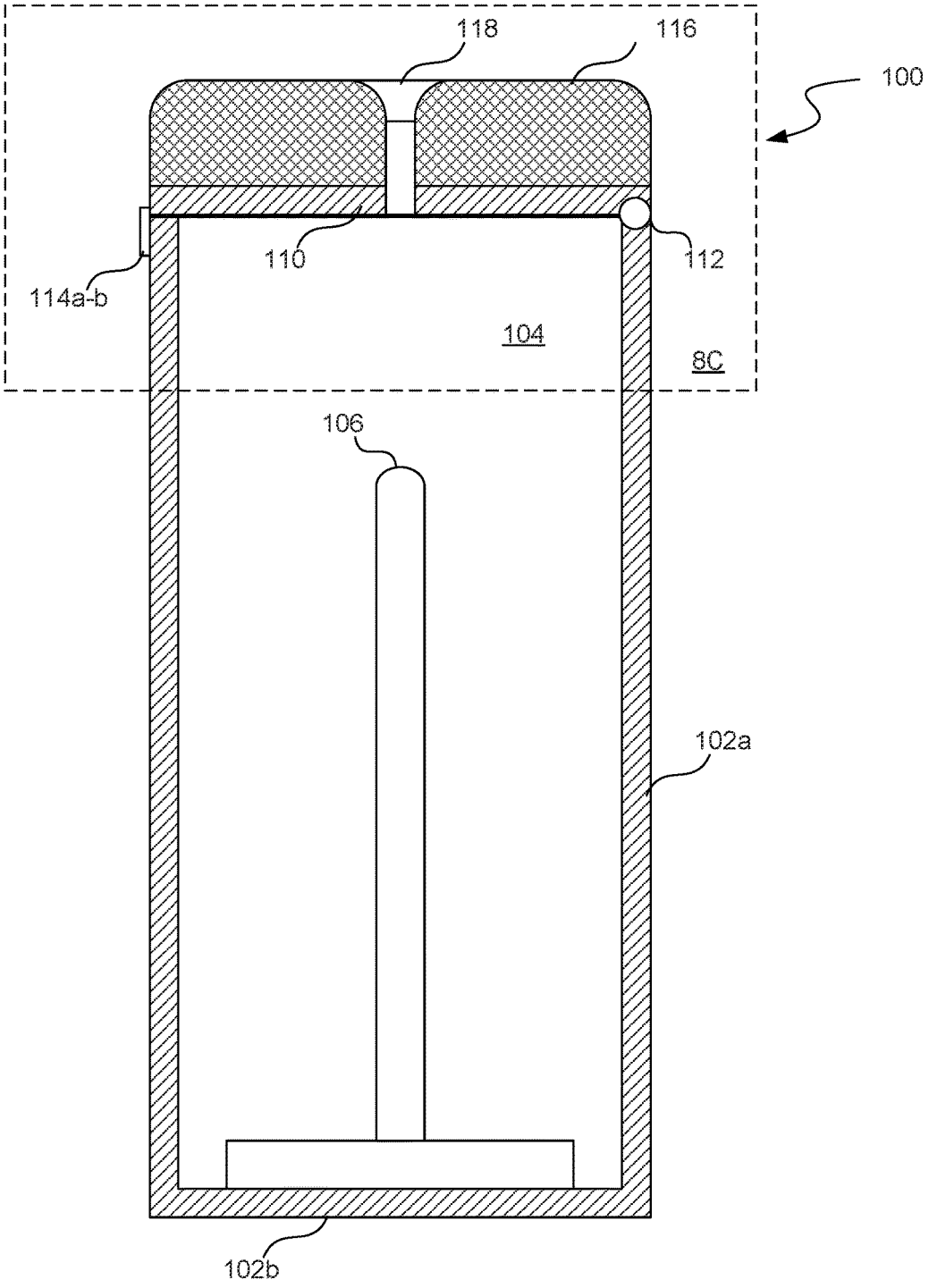
FIG. 8A shows a first section view of the example container of FIG. 1.
Figure 8B:
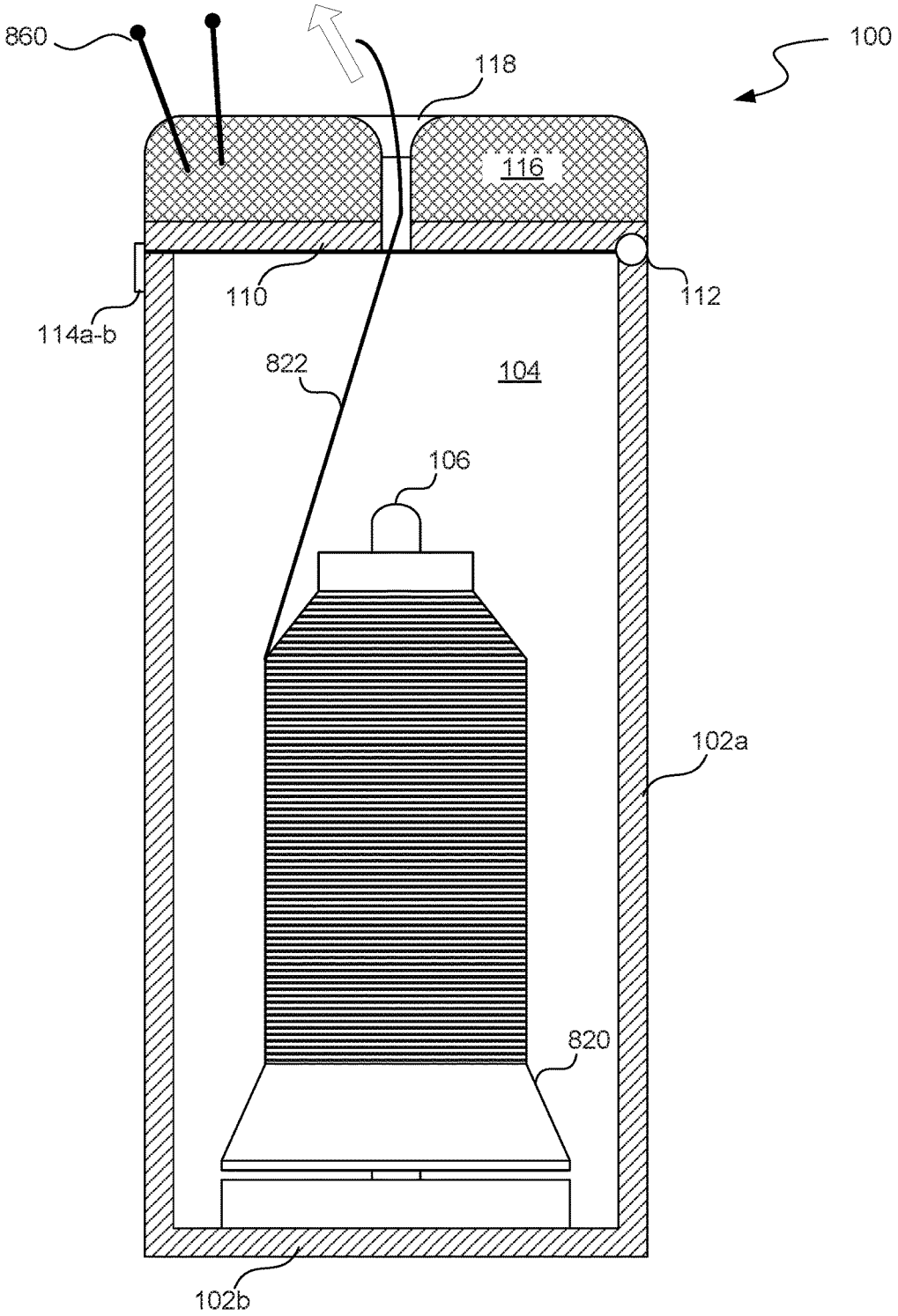
FIG. 8B shows a second section view of the example container of FIG. 1 illustrating the storage and dispensing of thread.
Figure 8C:
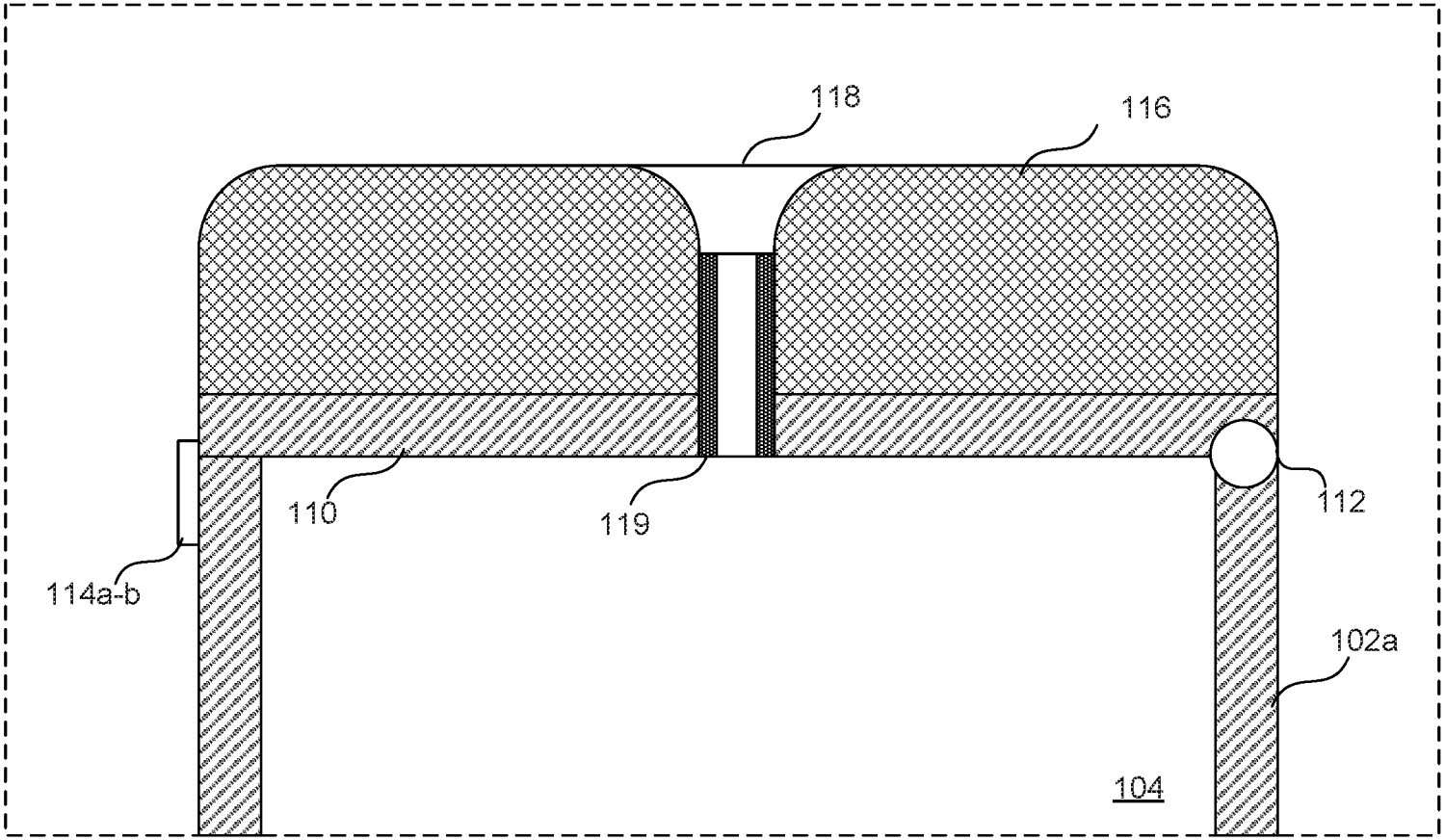
FIG. 8C shows a detail section of the example container of FIG. 1 illustrating the placement of a bushing to from a threading hole.

Example Embodiments of a Container for Thread Distribution and Needle Storage FIGS. 1-8C show several views of an example container 100, according to some embodiments. Specifically, FIGS. 1-4 show an isometric view, a front elevation view, a side elevation view, and a top view (respectively) of the example container 100 with its container top 110 in an open position. FIGS. 5-7 show a front elevation view, a side elevation view, and a top view (respectively) of the example container 100 depicted in FIGS. 1-4, but with the container top 110 in a closed position. FIG. 8A-8C show example sections of the example container 100.

Returning to FIG. 1, the example container 100 includes a housing 102 surrounding an interior space 104, a spindle 106 arranged within the interior space 104 for holding one or more spools of thread, and a container top 110 configured to open and close to enable access to the interior space 104 of the container 100, while in use.

Figure 1:
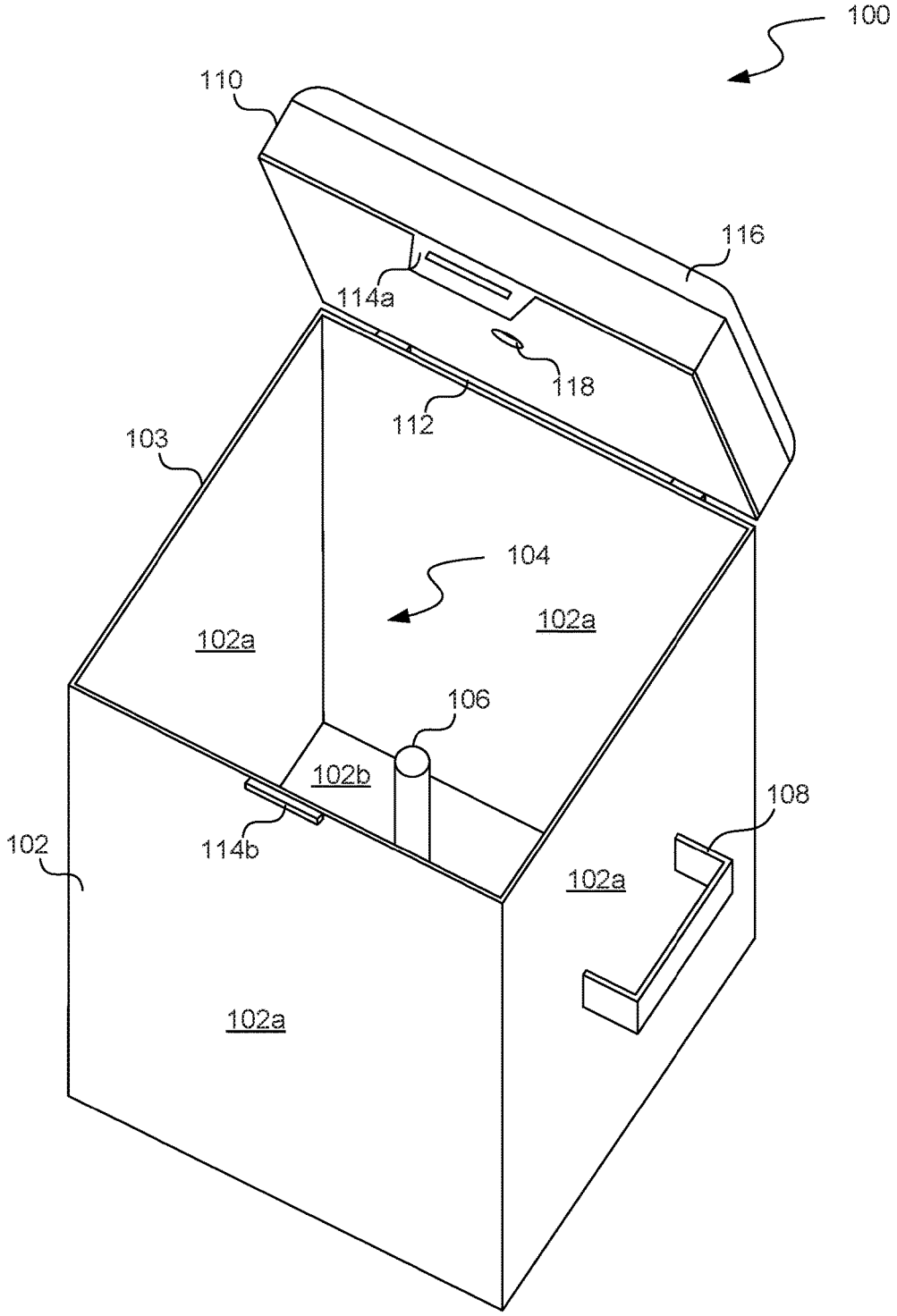
FIG. 1 shows an isometric view of a first example embodiment of a container with the container top open.
Figure 2:
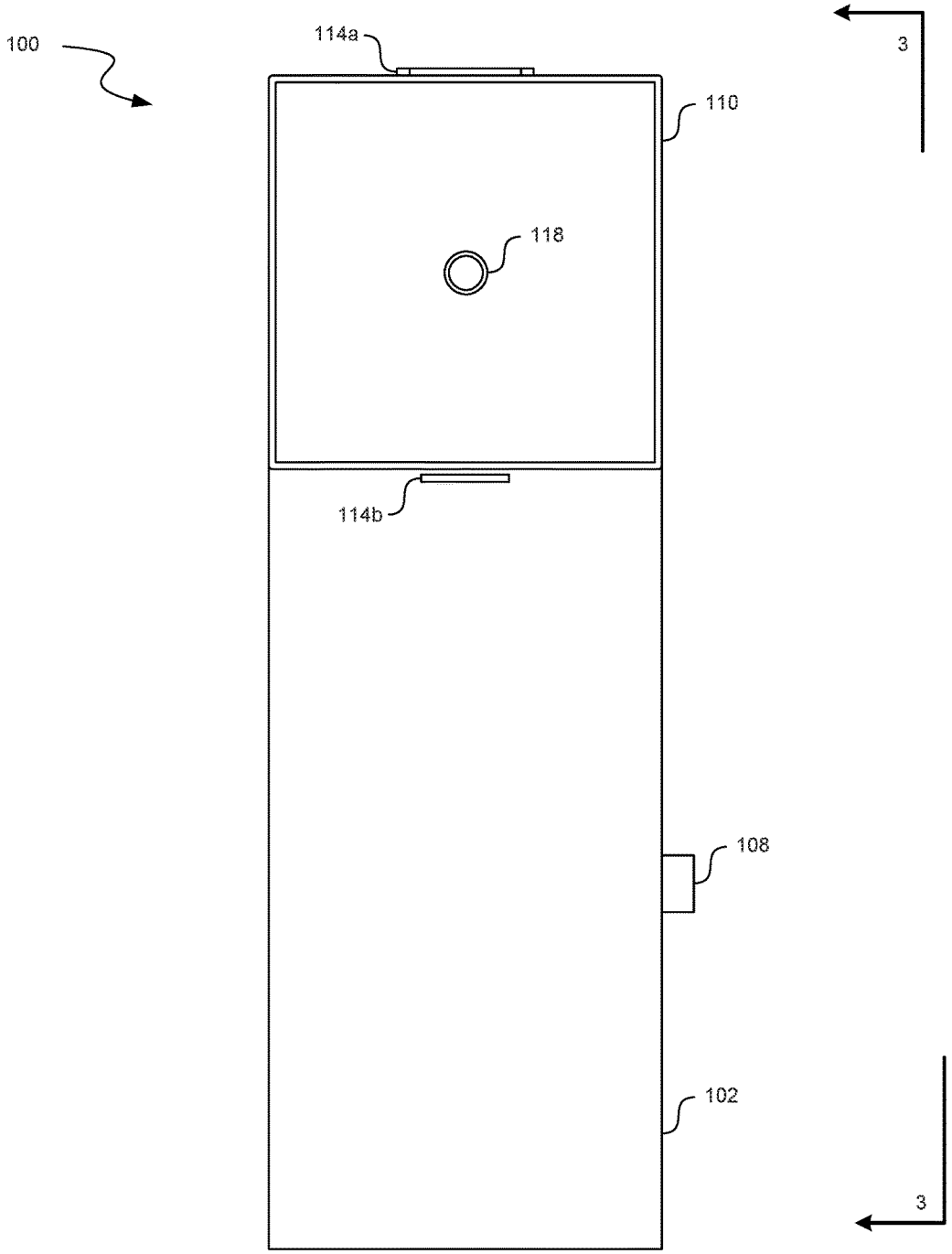
FIG. 2 shows a front elevation view of the example container of FIG. 1 with the container top open.
Figure 3:
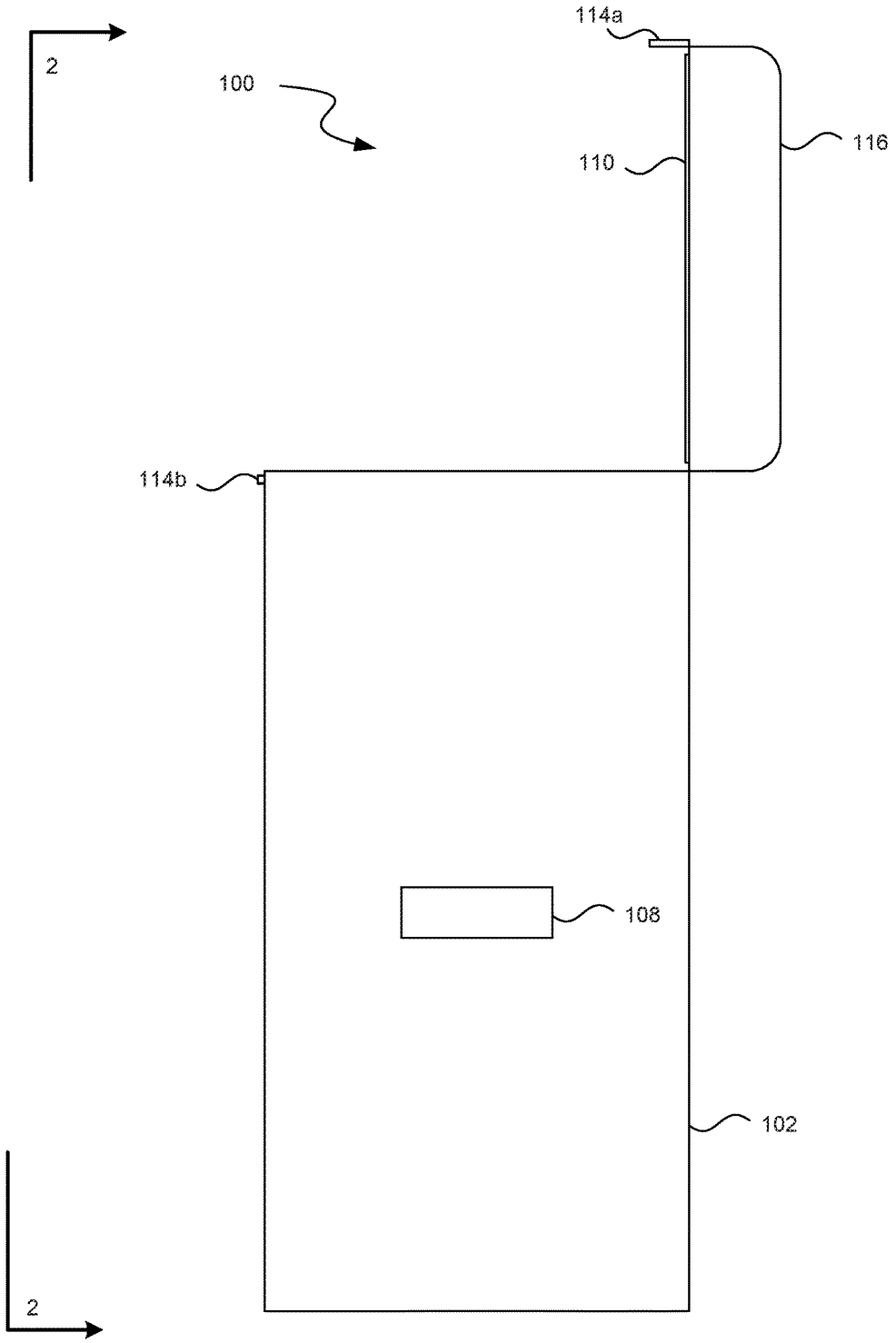
FIG. 3 shows a side elevation view of the example container of FIG. 1 with the container top open.
Figure 4:
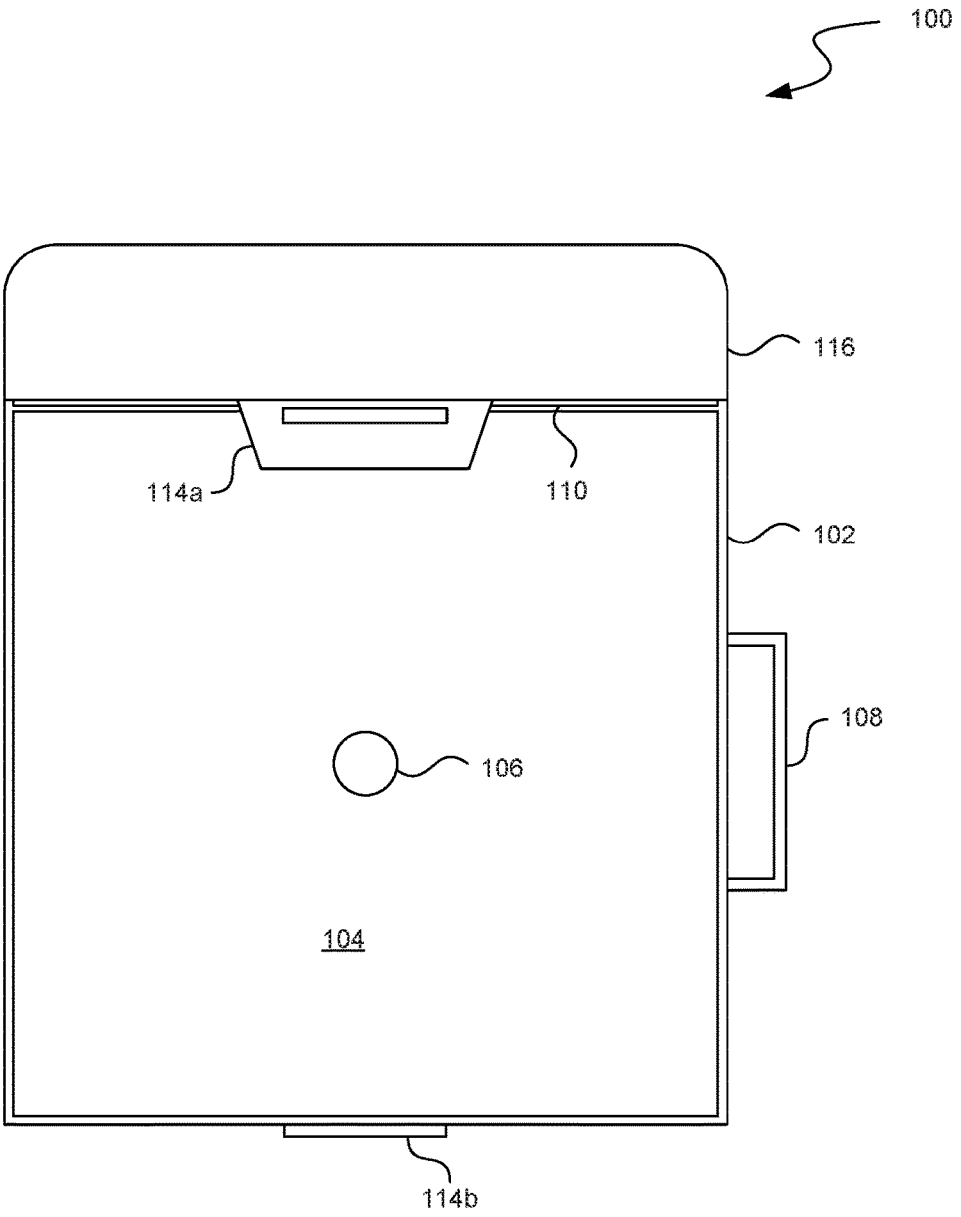
FIG. 4 shows a top view of the example container of FIG. 1 with the container top open.

The housing 102 comprises one or more walls surrounding and defining an interior space 104 of the container 100. In the example depicted in FIG. 1, the housing 102 comprises a plurality (e.g., four) of side walls 102*a* that along with a bottom wall 102*b* define the interior space 104. The interior space 104 is open to the exterior on at least one face where the container top 110 or other type of door mechanism is arranged to enclose the interior space 104 for storing items while enabling access to the interior space 104. In the example depicted in FIG. 1, the interior space 104 is open to the exterior at a top opening defined by the top edges 103 of each of the side walls 102*a*. The housing 102 may be formed from a single piece or from multiple pieces of any material suitable to provide a supportive structure, such as metal, plastic, wood, etc. In certain embodiments, the housing 102 can be manufactured as a single piece, for example, through an injection molding or milling process. Alternatively, in other embodiments, the housing 102 may be manufactured by affixing multiple pieces together to form the structure. Means for affixing multiple pieces of material to form the housing 102 will depend on the materials used, but may include, for example, adhesives, welding, mechanical fasteners (e.g., clips, screws, bolts, etc.), structural joints, or any other type of permanent or temporary means for affixing pieces together. Note that the housing 102 depicted in FIG. 1 is an example provided for illustrative purposes and is not to be construed as limiting. In other embodiments, the housing 102 may include more or fewer side walls, may include a single side wall (e.g., in a cylindrical configuration), may be dimensioned differently, proportioned differently, and/or may include ornamental features not depicted in FIG. 1.

The interior space 104 defined by the housing 102 can be of any shape or dimension configured to accommodate one or more units of thread. In the example depicted in FIG. 1, the housing 102 is arranged to form an interior space 104 that is generally a rectangular cuboid volume having dimensions capable of accommodating at least one spool of thread for use, for example, in sewing hair extensions (e.g., as depicted in FIG. 8B). Other embodiments may include a housing 102 arranged to form an interior volume of space of a different shape such as a generally cylindrical volume.

Enclosing the interior space 104 of the housing 102 is a container top 110 or some other type of door or hatch operable to enclose the interior space 104 when closed and provide a user access to the interior space 104 when opened. As previously mentioned, FIGS. 1-4 show several views of the example container 100 with the container top 110 in an open position and FIGS. 5-8C show several views of the example container 100 with the container top 110 in a closed position. In the example container 100 depicted in FIG. 1, the container top 110 is connected to a top edge 103 of one of the side walls 102*a* of the housing 102 by way of a hinge 112. The hinge 112 is rotatable about an axis thereby allowing the container top 110 to move between open and closed positions. The hinge 112 may be any type of hinge suitable for opening and closing the container top 110. Example hinge types include a butt hinge, a piano hinge, a butterfly hinge, a spring hinge, a pivot hinge, etc. Although represented as one component, the hinge 112 may comprise two or more separate hinge elements, for example, arranged at opposing ends of one side of the container top 110. In some embodiments, the container top 110, hinge 112, and at least a portion of the housing 102 may be formed of a single piece of material. For example, an embodiment is contemplated in which the container top 110 and at least a portion of the housing 102 are formed of a single piece of plastic (e.g., through injection molding), and the hinge 112 represents a region of material formed or cut a certain way so as to allow a portion of the piece of plastic comprising the container top 110 to rotate relative to a portion of the piece of plastic comprising the housing 102.

The container top 110 and housing 102 can include corresponding latch elements 114*a* and 114*b* (respectively) configured to connect to each other, thereby fastening the container top 110 in place when in a closed position. In the example depicted in FIG. 1, a first latch element 114*a* is affixed to a center of a front edge of the container top 110 and a second latch element 114*b* is affixed to a center of a top edge 103 of the side wall 102*a* of housing 102. The first latch element 114*a* includes a slot configured to detachably couple to the second latch element 114*b*. The latch 114*a-b* shown in FIG. 1 is an example provided for illustrative purposes. Other embodiments may include different types of components (e.g., magnets or a hook and loop fastener system) for fastening the container top 110 to the housing 102.

Arranged on a top surface of the container top 110 is a cushion 116 configured to hold pins and/or needles. The cushion 116 may cover a substantial portion of the top surface of the container top 110 (as depicted in FIG. 8A) thereby providing sufficient surface area for a user to store multiple pins and/or needles in an organized and easily accessible manner. The cushion 116 may comprise a cover made of a pliable porous material such as a fabric that surrounds a region of stuffing material such as sand, sawdust, plastic beads, cotton, steel wool, etc. To store, a user inserts the needles into the cushion 116 such that they pass through the cover and into the stuffing material that holds them in place. For example, FIG. 8B depicts a couple of pins 860 inserted into the cushion 116 on the top surface of the container top 110. The cushion 116 depicted in FIGS. 1-8C is an example provided for illustrative purposes, however other types of features may similarly be implemented to enable a user to easily store pins and/or needles, while in use. For example, the top surface of the container top 110 may be coated in a magnetic material or otherwise include magnets to which pins and/or needles can be detachably affixed.

In some embodiments, the container 100 can include mechanisms or structures for securing other tools, such as scissors, that may be accessed by a user such as hair stylist when sewing (e.g., to perform hair extension). For example, container 100 depicted in FIG. 1 includes a bracket 108 configured to secure a pair of scissors to an exterior of one of the side walls 102*a* of the housing 102. The bracket 108 may be constructed of the same material as the housing 102. In some embodiments, the bracket 108 may be formed as part of the housing 102, for example, through an injection molding process. In some embodiments, the bracket 108 may comprise or be replaced with a strap formed of a flexible material such as plastic or rubber cable extending and constricting to accommodate tools of different sizes. In any case, the bracket 108 may be configured to temporarily secure a tool to the container 100 thereby providing a user (e.g., a hair stylist) with easy access to the tool, while in use. The bracket 108 may be dimensioned and positioned so as to enable the user to easily secure and remove the tool with one hand without excessive exertion. In alternative embodiments, a bracket 108 may be replaced with other means of securing a tool such as a magnet (operable to secure metal tools), removable adhesives (e.g., a hook and loop fastener system), etc.

In some embodiments, the container 100 includes a mechanism or structure arranged within the interior space 104 for securing one or more spools of thread. For example, the container 100 depicted in FIG. 1 includes a spindle structure 106 in the form of a vertical dowel or rod about which a spool of thread can be secured, while in use. In the example depicted in FIG. 1, the spindle structure 106 comprises a dowel that is arranged vertically within the interior space 104 of the housing 102 and affixed at one end to an interior surface of a bottom wall 102*b* of the housing 102, for example, as more clearly depicted in the section view shown in FIG. 8A. As shown in FIG. 8A, the spindle structure 106 extends from an interior surface of a bottom wall 102*b* of the housing 102 towards the top of the housing 102. In the example depicted in FIG. 8A, the spindle structure 106 extends approximately ⅔ of the height of the housing 102; however, this is just an example configuration provided for illustrative purposes. In general, the arrangement of the spindle structure 106 within the interior space 104 of the container 100 will depend on the interior dimensions of the container housing 102 as well as the types of thread spools used. For example, depending on the height of the container housing 102, the spindle structure 106 may be configured to accommodate at least two spools of thread arranged one on top of the other.

The spindle structure 106 may be formed from a single piece or from multiple pieces of any material suitable to provide a supportive structure, such as metal, plastic, wood, etc. In some embodiments, the spindle structure 106 is formed as part of the housing structure 102 from a single piece of material, for example, through an injection molding or milling process. Alternatively, in other embodiments, the spindle structure 106 and housing 102 may be manufactured as separate pieces that are later assembled. In such embodiments, means for affixing the spindle structure 106 to the housing 102 will depend on the materials used, but may include, for example, adhesives, welding, mechanical fasteners (e.g., clips, screws, bolts, etc.), structural joints, or any other type of permanent or temporary means for affixing pieces together.

In some embodiments, the spindle structure 106 can be configured to be easily removable and replaceable by a user. For example, in some embodiments, the container 100 may be configured so as to allow a user to swap in and out different spindle structures (or other fastening structures) so as to accommodate different types of spools of thread.

Other types of structures or mechanisms may similarly be used to secure one or more spools of thread within the interior space 104 of the container 100, while in use. For example, in some embodiments, the spindle structure 106 may comprise a dowel arranged horizontally instead of vertically within the interior space 104 (e.g., as depicted in FIG. 8A).

FIG. 8B shows another section view, similar to the section view depicted in FIG. 8A, except with a spool of thread 820 in place about the spindle structure 106. The spool of thread 820 may include a cylindrical structure about which thread 822 is wound. The cylindrical structure of the spool 820 includes an open slot (not shown in FIG. 8B) that extends the length of the spool 820 and that is configured to accommodate the spindle structure 106. To install the spool 820 in the container 100, a user opens the container top 110 to gain access to the interior space 104 and places the spool 820 on the spindle structure 106 by sliding the open slot of the spool 820 over the vertical dowel of the spindle structure 106. When in place, the spool 820 is free to rotate about the spindle structure 106, for example, when thread 822 is unwound from the spool 820.

The container 100 can be configured to hold spools of different types of thread that may be used, for example, in performing hair extension services. Types of thread used can include, for example, all-purpose sewing thread, braiding thread, upholstery thread, carpet thread, etc. Further, the thread can be made of any suitable material such as cotton, polyester, silk, wool, etc. The term "thread" is used in this disclosure to refer to any type of continuous length fibrous material and shall be understood to include other terms such as "yarn," "string," "cord," "twine," "rope," etc.

The container top 110 includes a threading hole 118 through which thread 822 can be pulled from a spool 820 that is in place within the interior space 104 of the container 100 for distribution. As shown in FIG. 8B, the threading hole 118 passes through the container top 110 (as well as the cushion 116) so that thread 822 can be extracted from the spool 820 while the container top 110 is in a closed position. By arranging the container 100 such that the thread 822 emerges from the interior space 104 (via the threading hole 118) in close proximity to needles/pins 860 placed in the cushion 116, a user is able to easily access both, for example, using only one hand. This is particularly beneficial in certain contexts, such as when performing hair extension services, where a user's other hand may be occupied.

In the example depicted in FIG. 8B, the threading hole 118 is arranged so as to be substantially in line with the vertical dowel of the spindle structure 106. In this example configuration, the threading hole 118 is therefore arranged at approximately the centroid of the rectangular container top 110, for example, as shown in FIG. 7. This may allow the thread 822 to be unwound from the spool 820 without risk of snagging, but is not necessarily required in all embodiments. For example, other embodiments may include a threading hole 118 arranged at a location other than the centroid of the container top 110. Further, in some embodiments, the threading hole 118 may be arranged through one of the side walls 102*a* of the housing 102 instead of through the container top 110. The particular configuration of the threading hole 118 in a given embodiment will depend on a number of factors such as the shape and dimension of the container housing 102 and container top 110, the type of thread 822 used, as well as user preferences. For example, the threading hole 118 may be depicted in the Figures with an exaggerated diameter relative to the dimension of the housing 102. In practice, the diameter of the threading hole 118 need only be greater than the diameter of thread used.

In some embodiments, the openings of the threading hole 118 on the bottom and top surfaces of the container top 110 may be beveled to prevent snagging of the thread during distribution. In some embodiments the threading hole 118 may comprise a hollow bushing 119 (or sleeve) (e.g., made of metal, plastic, etc.) with an interior diameter configured to accommodate one or more threads, for example as depicted in FIG. 8C. During manufacture, a hole is drilled through (or formed as part of) the container top 110 into which the bushing 119 is placed. The bushing 119 forming the threading hole 118 may include beveled edges to prevent snagging.

Figure 9:
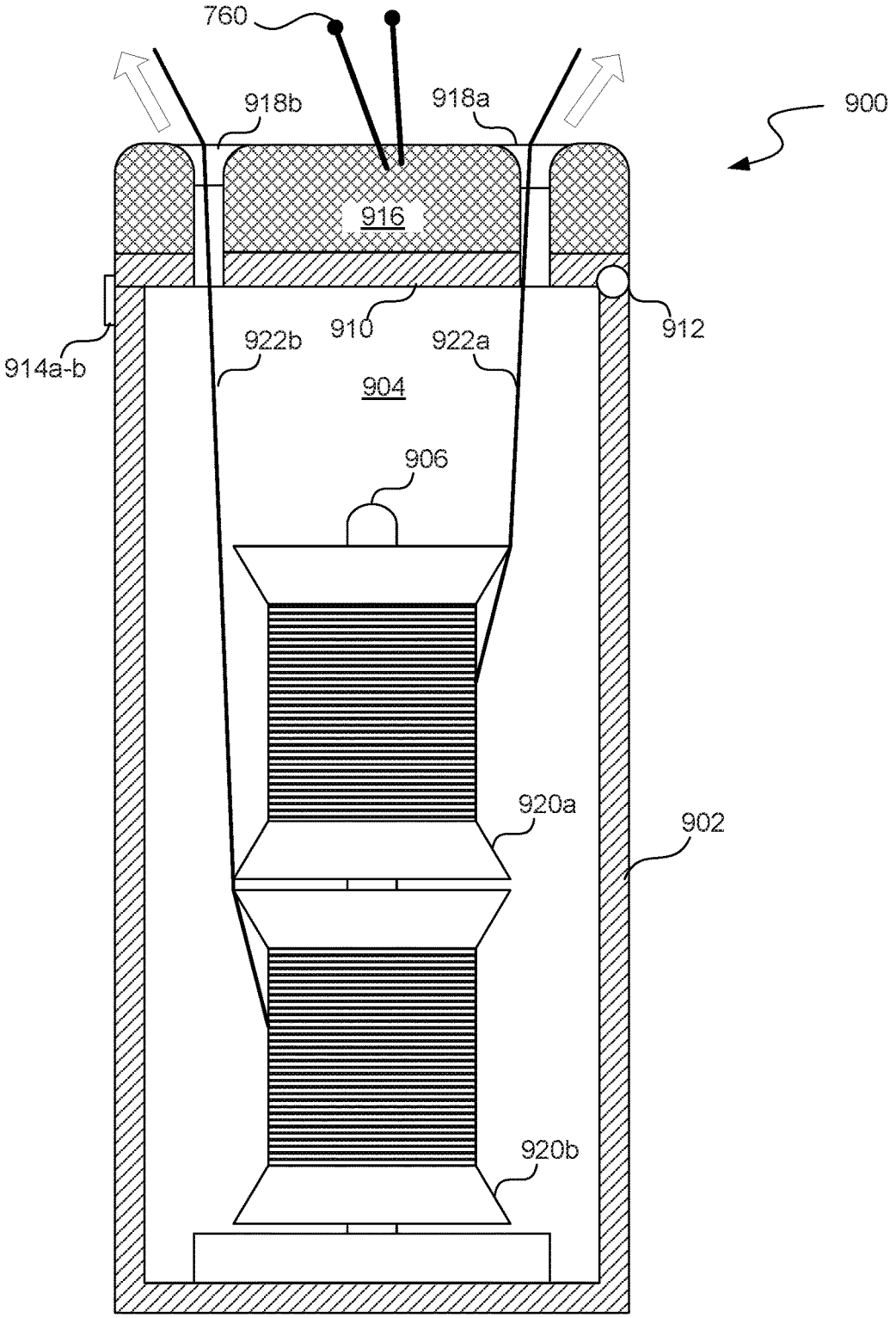
FIG. 9 shows a section of a second example embodiment of a container.

In some embodiments, the container top 110 may include multiple threading holes through which multiple threads can be extracted from spools stored in an interior space. FIG. 9 shows a section view of an example embodiment of a container 900 similar to the container 100 described with respect to FIGS. 1-8C. As shown in FIG. 9, the example container 900 includes a housing 902 (analogous to housing 102) enclosing an interior space 904 (analogous to interior space 104), a container top 910 (analogous to container top 110) including a cushion 916 (analogous to cushion 116) and rotatably attached to the housing 902 via a hinge 912 (analogous to hinge 112) and securable with a latch 914*a-b* (analogous to latch 114*a-b*).

The example container 900 differs from container 100 in that the container top 910 includes multiple threading holes 918*a-b*. In the example container 900 depicted in FIG. 9, multiple spools of thread 920*a* and 920*b* are stacked one over the other on the spindle structure 906 (analogous to spindle structure 106) located within the interior space 904. The first spool 902*a* may be of a first type or color and the second spool 920*b* may be of a second type or color. Thread 922*a* from the first spool 920*a* can be extracted from the interior space 904 via a first threading hole 918*a* and thread 922*b* from the second spool 920*b* can be extracted via a second threading hole 918*b*.

Figure 10:
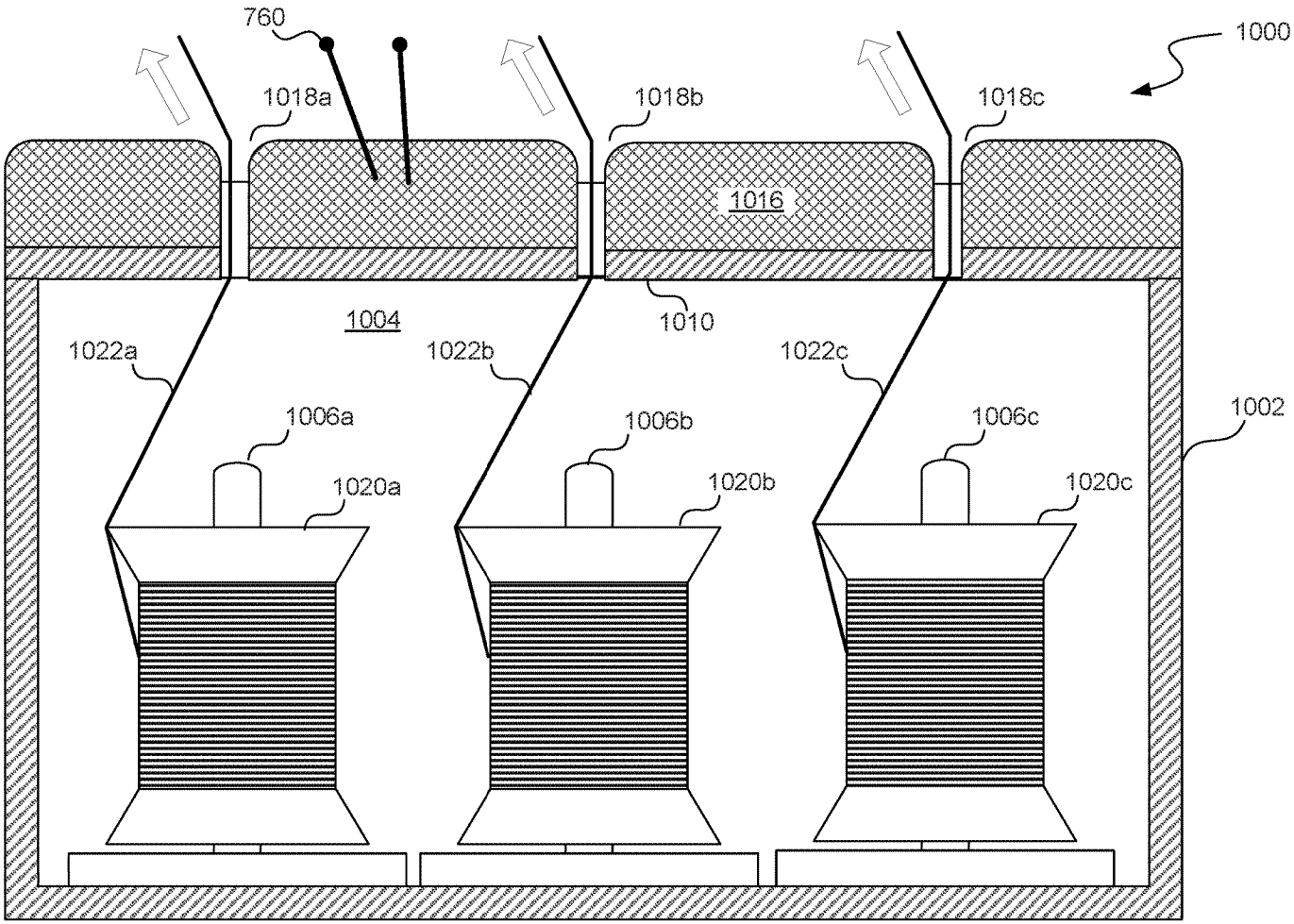
FIG. 10 shows a section of a third example embodiment of a container.

FIG. 10 shows a second view of another example embodiment of a container 1000 that also includes multiple threading holes. As shown in FIG. 10, the example container 1000 includes a housing 1002 (analogous to housing 102) enclosing an interior space 1004 (analogous to interior space 104) and a container top 1010 (analogous to container top 110) including a cushion 1016 (analogous to cushion 116). Note, certain components such as a hinge and latch are not shown in FIG. 10 for illustrative clarity, however the example container 1000 may nevertheless include such elements.

The example container 1000 differs from container 100 in that the container top 1010 includes multiple threading holes 1018*a-c* and the interior space 1004 includes multiple spindle structures 1006*a-c*. In the example container 1000 depicted in FIG. 10, multiple spools of thread 1020*a-c* in place about multiple spindle structures 1006 (respectively) located within the interior space 1004. The first spool 1020*a* may be of a first type or color, the second spool 1020*b* may be of a second type or color, and the third spool 1020*c* may be of a third type or color. Thread 1022*a* from the first spool 1020*a* can be extracted from the interior space 1004 via a first threading hole 1018*a*, thread 1022*b* from the second spool 1020*b* can be extracted via a second threading hole 1018*b*, and thread 1022*c* from the third spool 1020*c* can be extracted from the interior space 1004 via a third threading hole 1018*c*.

The alternative embodiments depicted in FIGS. 9 and 10 are provided to illustrate some example configurations for including multiple spools of thread that are extractable from multiple threading holes, however these examples are not to be construed as limiting. As previously mentioned, other embodiments may include more of fewer threading holes and/or spindle structures and may arrange the threading holes and/or spindle structures differently.

In some embodiments, the interior space of the container may be divided into multiple compartments. Multiple compartments may allow for organized storage of different tools and materials within a container. For example, the spools of thread can be stored in one compartment of the container, while tools such as needles are stored in another. As another example, spools of thread that are in use can be stored in one compartment, while extra spools of thread are stored in another.

Figure 11:
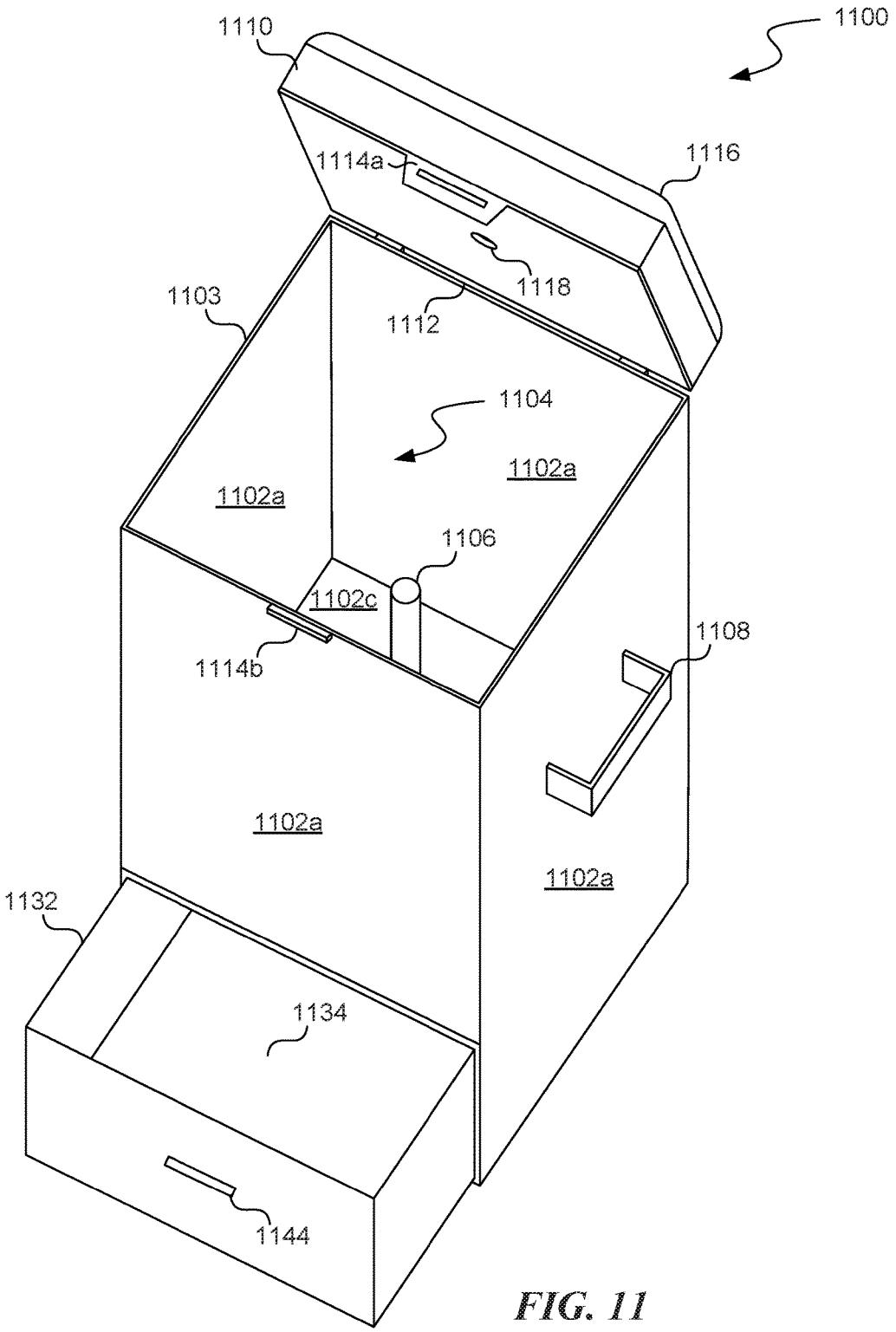
FIG. 11 shows an isometric view of a fourth example embodiment of a container.
Figure 12:
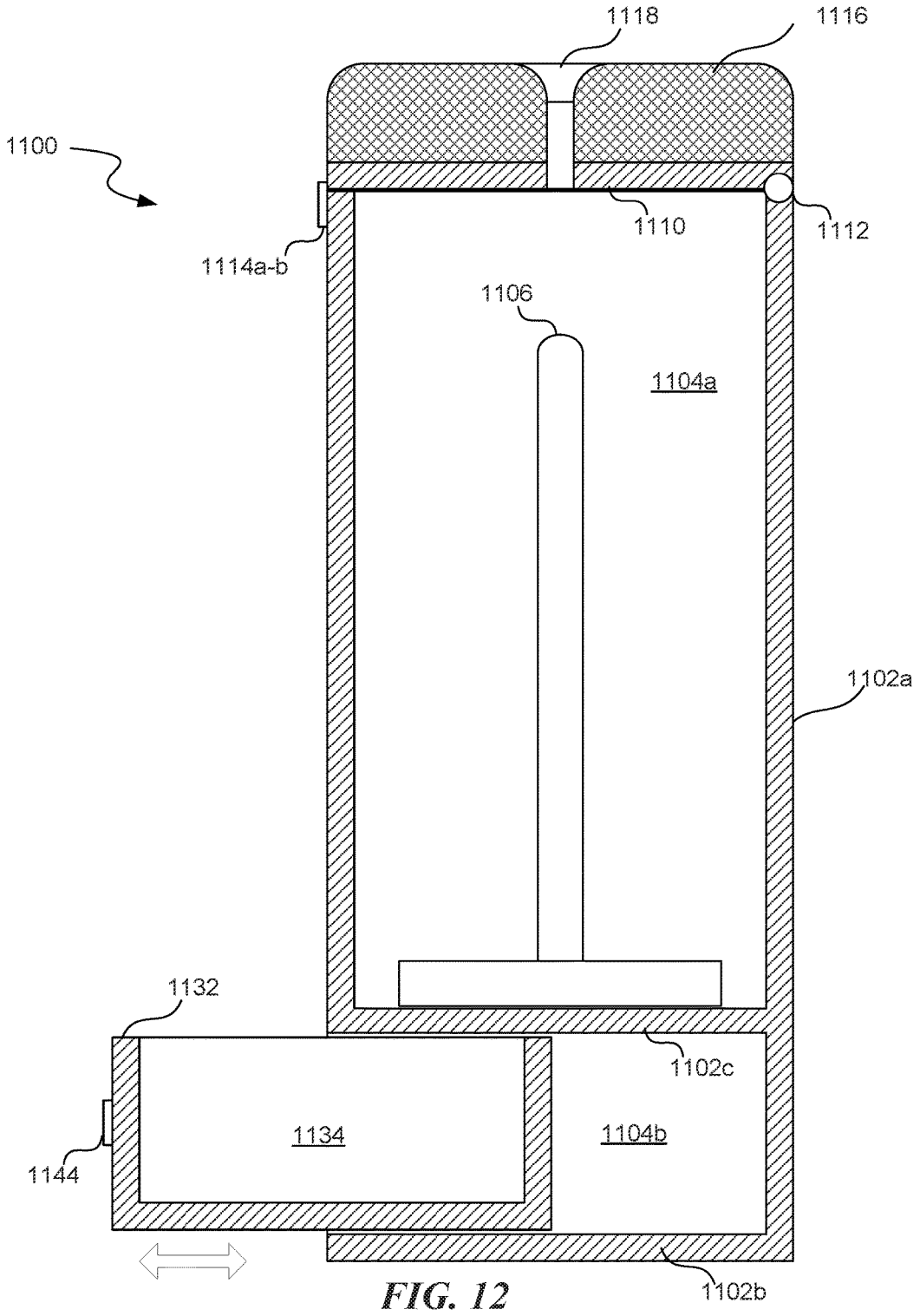
FIG. 12 shows a section view of the example container of FIG. 11.

FIG. 11 shows an isometric view of an example container 1100 that includes multiple storage compartments. FIG. 12 shows a corresponding section view of the example container 1100. Example container 1100 is similar to example container 100 in many respects. For example, similar to container 100, the example container 1100 includes a housing 1102 (analogous to housing 102) including a plurality of side walls 1102*a* and a bottom wall 1102*b* surrounding a first interior space 1104*a* (analogous to interior space 104), a spindle 1106 (analogous to spindle 106) arranged within the first interior space 1104*a* for holding one or more spools of thread, and a container top 1110 (analogous to container top 110) configured to open and close to enable access to the first interior space 1104*a* of the container 1100, while in use. The container top 1110 is connected to one of the side walls 1102*a* of the housing 1102 by way of a hinge 1112 (analogous to hinge 112). Arranged on a top surface of the container top 1110 is a cushion 1116 (analogous to cushion 116). The container top 1110 and housing 1102 can include corresponding latch elements 1114*a* and 1114*b* (respectively) (analogous to latch elements 114*a-b*) configured to connect to each other, thereby fastening the container top 1110 in place when in a closed position. The container top 1110 also includes a threading hole 1118 (analogous to threading hole 118) through which thread can be pulled from a spool that is in place within the first interior space 1104*a* of the container 1100.

The example container 1100 of FIG. 11 differs from the example container 100 in that the housing 1102 encloses another interior space 1104*b* that is adjacent to, but separate from, the first interior space 1104*a*. For example, as shown in FIGS. 11-12, in addition to a plurality of side walls 1102*a* and a bottom wall 1102*b*, the example container 1100 also includes an interior wall 1102*c* that is substantially parallel with the bottom wall 1102*b* and arranged at a point between the bottom wall 1102*b* and the top edges 1103 of the side walls 1102*a*. The interior wall 1102*c* separates the first interior space 1104*a* from the second interior space 1104*b*. Further, the spindle 1106 is affixed to the top surface of the interior wall 1102*c* such that it extends vertically within the first interior space 1104*a* towards the top edges 1103 of the side walls 1102*a*.

In the example depicted in FIGS. 11-12, the second interior space 1104*b* is open to the exterior via an opening in one of the side walls 1102*a* of the housing 1102. In some embodiments, this side opening into the second interior space 1104*b* may include a door or some other type of cover similar to the container top 1110 that is operable to enclose the second interior space 1104*b* when in a closed position and provide a user with access to the second interior space when in an open position. Alternatively, and as shown in FIGS. 11-12, the second interior space 1104*b* may include a drawer 1132 operable to slide horizontally in and out of the second interior space 1104*b*. The drawer 1132 includes a housing (e.g., constructed of the same or similar material as housing 1102) that defines a compartment 1134 that can be used, for example, to store supplies such as additional spools of thread, pins/needles, etc. The drawer 1132 also includes a handle 1144 arranged along an exterior side wall of the housing 1102. To gain access to the compartment 1134, a user can pull on a handle 1144 to slide the drawer 1132 in and out of the second interior space 1104*b* (e.g., as illustrated in FIG. 12).

Figure 13:
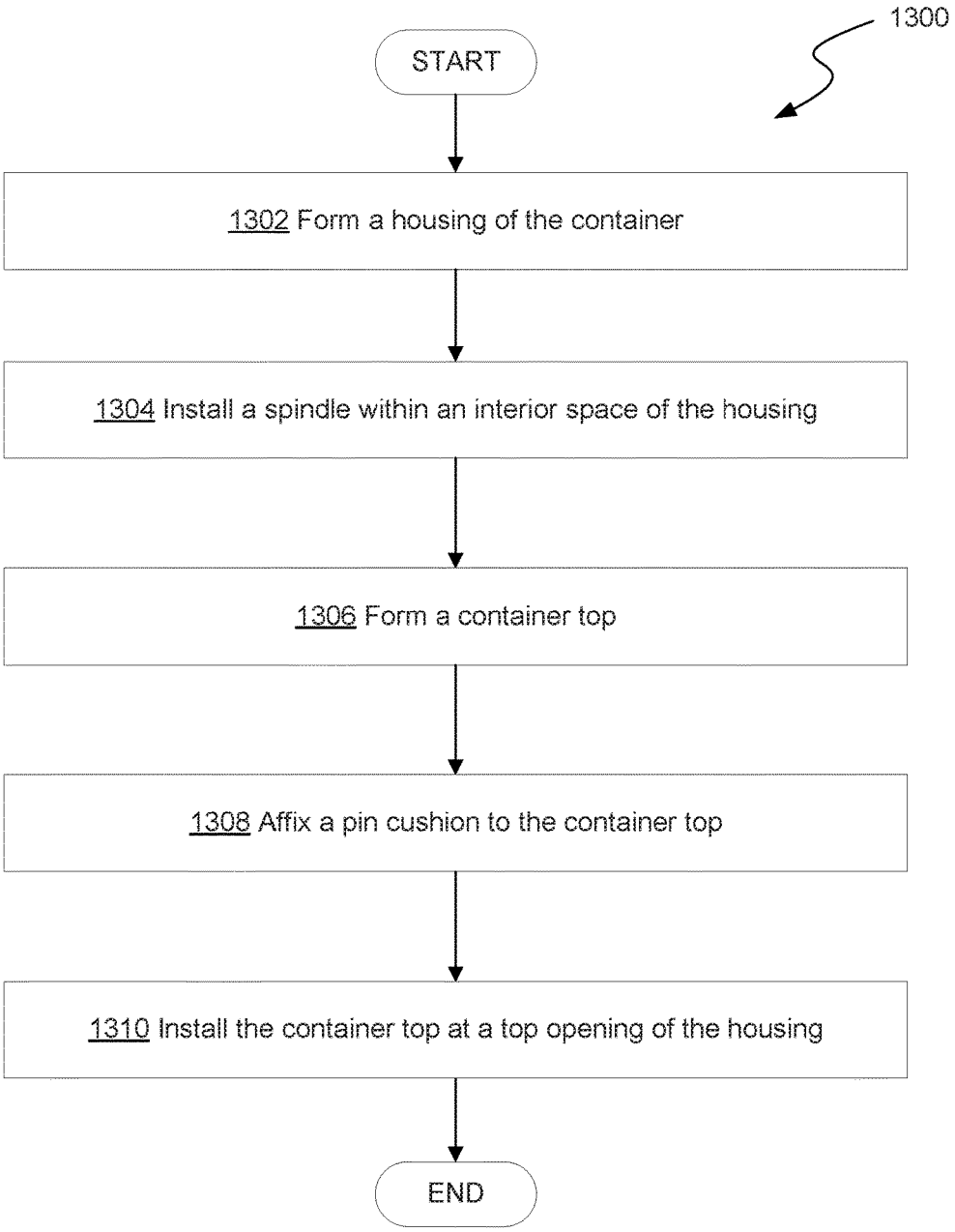
FIG. 13 is a flow diagram of an example process for manufacturing a container for thread distribution and needle storage.

Example Method for Manufacturing a Container for Thread Distribution and Needle Storage FIG. 13 shows a flow diagram of an example process 1300 for manufacturing a container for thread distribution and needle storage, for example, similar to any of the example containers described with respect to FIGS. 1-12. For clarity, process 1300 is described in the context of manufacturing the container 100 described with respect to FIGS. 1-8C, but can also be applied to the manufacture of alternative embodiments. Further, the example process 1300 is described for illustrative purposes and is not to be construed as limiting. A container in accordance with the present disclosure may be manufactured by other processes that, for example, include fewer or more steps than example process 1300, combine or separate out steps differently than example process 1300, and/or order steps differently than example process 1300.

Process 1300 begins at step 1302 with forming a housing 102 of the container 100. As previously discussed, the housing 102 can include a bottom wall 102*b* and a plurality of side walls 102*a* that, along with the bottom wall 102*b*, form an interior space 104 of the housing 102 with a top opening opposite the bottom wall 102*b*, the top opening defined by a top edge 103 of the side walls 102*a*. In some embodiments, the housing 102 may also include an interior wall 1102*c* that separates the interior space into a first interior space 1104*a* and a second interior space 1104*b*. In some embodiments housing 102 can be formed of a single piece of any type of material suitable to provide a supportive housing, such as metal or plastic. A unitary housing 102 can be forged, molded (e.g., injection molding), machined, or otherwise processed into a desired shape. Alternatively, in some embodiments, housing 102 may be formed of several prefabricated structural components configured and fastened together to form the desired shape.

Process 1300 continues at step 1304 with installing a spindle 106 within the interior space 104. As previously discussed, the spindle 106 may comprise a cylindrical dowel that includes a proximate end and a distal end. Accordingly, this step may involve affixing the proximate end of the dowel to an interior surface of the bottom wall 102*b* of the housing 102 such that when in place the dowel extends vertically within the interior space towards the top edge 103 of the side walls 102*a*. Alternatively, in some embodiments, the spindle 106 may be formed as part of the housing 102 at step 1302. For example, a housing 102 formed of a single piece of material through an injection molding process. The mold utilized to form the housing 102 may be configured such that a cylindrical structure extends from an interior surface of the bottom wall 102*b* of the housing 102, thereby constituting the spindle 106.

Process 1300 continues at step 1306 with forming a container top 110 configured to enclose the top opening of the housing 102. In other words, the container top 110 may be dimensioned based on the top edges 103 of the side walls 102*a* of the housing 102. In an embodiment, the container top 110 is a substantially flat piece of material (e.g., the same material as housing 102) of a thickness similar to that of the side walls 102*a* and/or bottom wall 102*b*. As with the housing 102, the container top 110 can be formed of a single piece of any type of suitable material such as metal or plastic. A unitary container top 110 can be forged, molded (e.g., injection molding), machined, or otherwise processed into a desired shape. Alternatively, in some embodiments the container top 110 may be formed of several prefabricated pieces configured and fastened together to form the desired shape. In some embodiments, the container top 110 may be formed as part of the housing 102. For example, a unitary housing 102 may be formed of a single piece of plastic through injection molding. The container top 110 may represent a leaf or portion that extends from one of the side walls 102*a*. An area of the housing 102 between the side wall 102*a* and container top 110 portion may be scored, etched, or otherwise formed so as to allow the container top portion 110 to bend at a 90 degree angle so as to close the top opening of the housing 102. In such an embodiment, this area between the container top portion 110 and the side wall 102*a* at which point the bending occurs would functionally replace any separate hinge mechanism 112.

As also previously discussed, the container top 110 includes at least one threading hole 118 for thread distribution. In some embodiments, the threading hole 118 through the container top 110 may be formed as a feature when the container top 110 is formed. For example, a mold used in an injection molding process may be configured such that the resulting container top 110 piece has a threading hole 118. Alternatively, the threading hole 118 may be created after the container top 110 is formed, for example, by drilling or punching a hold through the material of the formed container top 110. In some embodiments, the step of creating the threading hole 118 may include forming a bushing 119 (e.g., though injection molding or machining depending on the material) and installing the bushing 119 in the hole created in the container top 110 (e.g., as depicted in FIG. 8C).

Process 1300 continues at step 1308 with affixing a pin cushion 116 to the container top 110. The pin cushion 116 may be a prefabricated pin cushion (i.e., comprising a porous cover surrounding a region of stuffing material) that is affixed to a surface of the container top 110 using an adhesive such as a glue. Alternatively, in some embodiments, the pin cushion 116 may be fabricated as part of the container top 110, for example by placing or affixing the stuffing material to a surface of the container top 110 and then wrapping the combination of the container top 110 and stuffing material (partially or completely) with a porous cover material such as a fabric. Note that in order to allow thread to pass through the container top, the pin cushion 116 is affixed to the container top 110 in such a way so as not to block the threading hole 118. In other words, in some embodiments, when the pin cushion 116 is affixed to the container top, the threading hole 118 extends through both the container top 110 and pin cushion 116 so as to allow thread to pass from the interior space 104 of the container to the exterior.

Process 1300 concludes at step 1310 with installing the container top 110 (with the affixed pin cushion 116) to the housing 102. Specifically, in some embodiments, the container top 110 may be affixed to the housing 102 via a hinge 112 at a top edge 103 of one of the side walls 102*a* such that the container top 110 is able to move between an open and closed position.

Remarks

The foregoing description of various embodiments has been provided for the purposes of illustration and description. It is not intended to be exhaustive or to limit the claimed subject matter to the precise forms disclosed. Many modifications and variations will be apparent to one skilled in the art. Embodiments were chosen and described in order to best describe the principles of the invention and its practical applications, thereby enabling others skilled in the relevant art to understand the claimed subject matter, the various embodiments, and the various modifications that are suited to the particular uses contemplated.

Although the above Detailed Description describes certain embodiments and the best mode contemplated, no matter how detailed the above appears in text, the embodiments can be practiced in many ways. Details of the apparatus and methods may vary considerably in their implementation details, while still being encompassed by the specification. As noted above, particular terminology used when describing certain features or aspects of various embodiments should not be taken to imply that the terminology is being redefined herein to be restricted to any specific characteristics, features, or aspects of the invention with which that terminology is associated. In general, the terms used in the following claims should not be construed to limit the invention to the specific embodiments disclosed in the specification, unless those terms are explicitly defined herein. Accordingly, the actual scope of the invention encompasses not only the disclosed embodiments, but also all equivalent ways of practicing or implementing the embodiments under the claims.

The language used in the specification has been principally selected for readability and instructional purposes, and it may not have been selected to delineate or circumscribe the inventive subject matter. It is therefore intended that the scope of the invention be limited not by this Detailed Description, but rather by any claims that issue on an application based hereon. Accordingly, the disclosure of various embodiments is intended to be illustrative, but not limiting, of the scope of the embodiments, which is set forth in the following claims.

What is claimed is:

1. A container apparatus for thread distribution and needle storage, the container apparatus comprising:

a housing comprising:

a bottom wall;

an interior wall parallel with the bottom wall and four side walls perpendicular to the bottom wall and interior wall;

wherein the four side walls and interior wall comprise:

a first interior space with a top opening opposite the interior wall, the top opening defined by a top edge of the side walls; and a second interior space between the bottom wall and the interior wall, the second interior space with a side opening in one of the four side walls;

a spindle within the first interior space of the housing, the spindle comprising:

a cylindrical dowel having a proximate end and a distal, the proximate end of the dowel affixed to the interior wall such that the cylindrical dowel extends vertically within the first interior space of the housing from the interior wall towards the top opening;

a drawer configured to slide horizontally into and out of the second interior space; and a container top connected to a top edge of one of the four side walls of the housing via a hinge, the hinge enabling the container top to move between a closed position and an open position, the closed position covering the top opening of the housing and thereby enclosing the first interior space, the open position enabling a user to access the first interior space, the container top including:

a pin cushion affixed to an exterior surface of the container top; and a threading hole through the container top and pin cushion;

wherein the threading hole through the container top and pin cushion includes a bushing with an interior diameter configured to enable thread to be extracted from a spool of thread in place about the spindle in the first interior space when the container top is in the closed position.

2. A container apparatus for thread distribution and needle storage, the container apparatus comprising:

a housing including one or more walls surrounding and defining an interior space;

a spindle arranged within the interior space of the housing, the spindle configured to hold a spool of thread; and a container top configured to enclose the interior space when in a closed position and enable access to the interior space when in an open position;

a cushion on an exterior surface of the container top; and a hole through the container top and cushion;

wherein the hole through the container top and cushion includes a bushing with an interior diameter configured to enable thread to be extracted from a spool of thread when in place about the spindle in the interior space when the container top is in the closed position.

3. The container apparatus of claim 2, wherein the housing includes:

a bottom wall; and a plurality of side walls that, along with the bottom wall, form the interior space of the housing with a top opening opposite the bottom wall, the top opening defined by a top edge of the side walls;

wherein the container top is arranged at the top opening, when in place.

4. The container apparatus of claim 2, wherein the interior space is generally a rectangular cuboid volume.

5. The container apparatus of claim 2, wherein the container top is connected to one of the walls of the housing by way of a hinge, the hinge configured to allow the container top to move between the closed position and open position.

6. The container apparatus of claim 2, wherein the spindle comprises a cylindrical dowel arranged vertically within the interior space of the housing and affixed at one end to an interior surface of a bottom wall of the housing.

7. The container apparatus of claim 2, further comprising:

a first latch element affixed to a center front edge of the container top; and a second latch element affixed to a top edge of a side wall of the housing, wherein the first latch element and second latch element are positioned and configured to detachably connect to each other when the container top is in a closed position, thereby securing the container top in place.

8. The container apparatus of claim 2, wherein the hole through the container top is positioned generally above the spindle when the container top is in the closed position.

9. The container apparatus of claim 2, further comprising:

a bracket affixed to an exterior surface of the housing, the bracket configured to secure a pair of scissors to the container apparatus.

10. The container apparatus of claim 2, wherein walls of the housing surround and define a second interior space that is below the first interior space, the first interior space and second interior space separated by an interior wall.

11. The container apparatus of claim 10, further comprising:

a drawer configured to slide horizontally into and out of the second interior space.

12. The container apparatus of claim 2, wherein the cushion is a pin cushion configured to secure pins and/or needles.

13. The container apparatus of claim 2, wherein the housing is made of any of metal, plastic, or wood.

14. The container apparatus of claim 2, further comprising:

a second hole through the container top and cushion, the second hole configured to enable a second thread to be extracted from a second spool of thread when in place about the spindle in the interior space when the container top is in the closed position.

15. The container apparatus of claim 2, further comprising:

a second spindle arranged within the interior space of the housing, the second spindle configured to hold a second spool of thread.

16. A method of manufacturing a container for thread distribution and needle storage, the method comprising:

forming a housing that includes a bottom wall and a plurality of side walls that, along with the bottom wall, form an interior space of the housing with a top opening opposite the bottom wall, the top opening defined by a top edge of the side walls;

installing a spindle within the interior space of the housing by affixing the spindle to an interior surface of the bottom wall of the housing;

forming a container top having dimensions based on the top opening of the housing, the container top including a hole therethrough;

affixing a pin cushion to the container top;

wherein the hole through the container top extends through the pin cushion affixed to the container top;

installing a bushing in the hole through the container top and pin cushion; and installing the container top with the affixed pin cushion to the housing using a hinge such that, when in use, the container top is able to move between an open and closed position.

17. The method of claim 16, wherein forming the housing and/or forming the container top is performed using an injection molding process.

18. The method of claim 16, wherein the spindle comprises a cylindrical dowel having a proximate end and a distal end, and wherein installing the spindle includes:

affixing the proximate end of the dowel to the interior surface of the bottom wall using an adhesive such that, when in place, the dowel extends vertically within the interior space of the housing from the bottom wall towards the container top.

* * * * *